US005662148A

United States Patent [19]

Jacobsson et al.

[11] Patent Number: 5,662,148

[45] Date of Patent: Sep. 2, 1997

[54] THREAD FEED SYSTEM HAVING AN AUXILLIARY CONVEYOR DEVICE

[75] Inventors: Kurt Arne Gunnar Jacobsson; Lars Tholander, both of Ulricehamn; Paer Josefsson, Borås, all of Sweden

[73] Assignee: IRO AB, Ulricehamn, Sweden

[21] Appl. No.: 454,260

[22] PCT Filed: Dec. 1, 1993

[86] PCT No.: PCT/EP93/03373

§ 371 Date: Jul. 28, 1995

§ 102(e) Date: Jul. 28, 1995

[87] PCT Pub. No.: WO94/12709

PCT Pub. Date: Jun. 9, 1994

[30] Foreign Application Priority Data

Dec. 3, 1992 [DE] Germany ..... 42 40 710.9
Feb. 15, 1993 [DE] Germany ..... 43 04 496.4

[51] Int. Cl.[6] ..... D03D 47/34

[52] U.S. Cl. ..... 139/450; 139/452

[58] Field of Search ..... 139/450, 452, 139/194; 242/47.01

[56] References Cited

U.S. PATENT DOCUMENTS

| | | | |
|---|---|---|---|
| 4,450,874 | 5/1984 | Brouwer et al. | 139/450 |
| 4,838,319 | 6/1989 | Suwa | 139/450 |
| 5,137,059 | 8/1992 | Baeck et al. | 139/452 |
| 5,168,903 | 12/1992 | Suwa | 139/452 |
| 5,385,310 | 1/1995 | Tholander | 242/47.01 |

FOREIGN PATENT DOCUMENTS

| | | | |
|---|---|---|---|
| 900 041 | 1/1985 | Belgium . | |
| 0 195 469 A3 | 9/1986 | European Pat. Off. . | |
| 0 253 359 A2 | 1/1988 | European Pat. Off. . | |
| 000454199 | 10/1991 | European Pat. Off. | 139/450 |
| 0 510 735 A1 | 10/1992 | European Pat. Off. . | |
| WO90/07600 | 7/1990 | WIPO . | |

*Primary Examiner*—Andy Falik

*Attorney, Agent, or Firm*—Flynn, Thiel, Boutell & Tanis, P.C.

[57] ABSTRACT

A thread feed system having a measuring feeder, a supply bobbin supplying thread to the measuring feeder and a textile machine which withdraws the thread from the measuring feeder so as to perform a weaving operation. The measuring feeder includes a storage drum and a winding element which removes the thread from the supply bobbin and winds the thread onto the storage drum. A control device is provided for monitoring the operating conditions of the thread system so as to identify increases in thread tension. The control device is operatively connected to an auxiliary conveyor device having a drivable friction roll which is frictionally engaged with the thread between the supply bobbin and the storage drum. The auxiliary conveyor device is operable so as to provide an increased frictional action on the thread so as to advance the thread at an increased rate to the storage drum so as to preparatorily counteract the thread tension increase and eliminate short picks of the thread in the textile machine.

18 Claims, 4 Drawing Sheets

THREAD FEED SYSTEM HAVING AN AUXILLIARY CONVEYOR DEVICE

FIELD OF THE INVENTION

The present invention relates to a method for controlling a thread feed system and to a thread feed system having a measuring feeder which comprises a storage drum and a winding element for winding thread stock onto the storage drum.

DESCRIPTION OF THE RELATED ART

In a method known from EP-A2-0 195 469, the jet-weaving machine works in accordance with the weft mixing principle, i.e., identical threads are alternately withdrawn from at least two measuring feeders. A control device monitors the operation and reacts to failure, for instance thread breakage, in such a manner that the one measuring feeder is controlled such that it assumes the function of the defective measuring feeder or even feeders. In a measuring feeder having a plurality of stop elements distributed over the circumference of the storage drum, the thread length is composed of whole turns and of fractions defined by the spacings of the stop elements. In a measuring feeder comprising one-stop element, the thread length is composed of whole turns and the diameter of the storage drum is adjusted accordingly. Since upon withdrawal of the thread along the thread path a thread tension builds up in the thread and since the thread tension is also felt in the turns in the thread stock on the storage drum, the thread length is adjusted such that the thread tension building up in the thread stock under normal operation is taken into account. When a measuring feeder assumes the function of a defective measuring feeder, the pick frequency will be doubled. The speed level rises. The tension within the thread increases. The original adjustment of the thread length is no longer correct; the thread length of the thread section in its relaxed state within the textile machine will be too short. This will result in short picks. Moreover, when the resistance to withdrawal from the supply bobbin increases, such a risk will even be enhanced.

In other weaving methods using measuring feeders, the thread length is also determined and set in advance. Since the supply bobbin is emptied relatively rapidly and is capable of carrying a considerable amount of thread, the diameter of the thread windings on the supply bobbin also changes considerably from a new supply bobbin to an empty supply bobbin. With a decreasing diameter of the thread windings the winding-on tension, which is the withdrawal tension of the thread being removed from the supply bobbin, increases, as well as the thread tension in the thread stock on the storage drum, so that the set thread length can no longer be maintained. This entails the risk of short picks. The risk is especially great at a high speed level.

To avoid short picks, the thread length has so far been set in advance to the high tension under critical operating conditions, which leads to expensive waste under normal operating conditions. The thread tension which varies in response to the Operating condition, as well as the undesired effect thereof which varies the set thread length are thus taken into account through a corresponding addition in the thread length. Measuring feeders can thus not fulfill the task of keeping a constant thread length in practice, as is actually presupposed in theory.

WO 90/07 600 discloses a thread feed device in which the supply bobbin and the measuring feeder have provided thereinbetween a friction drive which performs an assisting conveying function by means of a driven friction roll in order to avoid undesired great stresses on the thread and to reduce the number of thread breakages. The surface of the friction roll is provided with axially defined surface coatings of different slip tendencies which are arranged side by side and adapted to the thread qualities of different threads, and of which the respectively suited surface coating is used for auxiliary conveyance. The thread follows a fixed thread path over the friction roll.

It is the object of the present invention to provide a method of the above-mentioned kind and a thread feed system with the aid of which the picked thread length can be kept relatively constant and can be set without the risk of short picks and with a view to little waste.

SUMMARY OF THE INVENTION

This object is achieved with the method wherein thread is acted upon by an auxiliary frictional force along a thread path from a supply bobbin to a storage drum, and with the thread feed system wherein a mechanical auxiliary conveyor device is provided between the supply bobbin and the measuring feeder which supplies a frictional force to the thread. The features of the thread feed systems which include adjusting the circumference of the storage drum by a triggerable power accumulator and the aforementioned auxiliary conveyor device can be combined with one another.

Upon occurrence of a critical operating state, an increase in the thread tension in the thread stock which is critical with a view to the observance of the thread length is counteracted in the method through a conveying frictional action on the thread. The thread turns on the storage drum are increased in order to increase the thread length to be consumed despite a thread tension in the turns which is increased under critical operating conditions, i.e., to such an extent that the thread length becomes approximately correct after relaxation. The two method steps can be used alternatively or additively. In practice, they guarantee an approach of the function of the measuring feeder to the idealized theoretical function thereof, since the withdrawn thread length does not vary. The thread length can be adjusted very accurately from the start so that there is little waste and short picks are nevertheless avoided.

In the thread feed system having the mechanical auxiliary conveyor device, the auxiliary conveyor device permits a selective action, for instance during a critical operating state, for avoiding an undesired increase in the thread tension in the turns on the storage drum.

In the embodiment wherein the compensating position of a circumferentially-defined longitudinal section can be adjusted, such adjustment can take place for instance as soon as a critical operating condition arises. Since the turns in the stock are then greater, the increase in tension is approximately compensated by an addition to the thread length. In a storage drum of an invariable diameter and with a plurality of stop elements, the circumferential length of the storage drum is increased. In a storage drum of a variable diameter and with one stop element the longitudinal section increases the circumferential length independently of the respectively set diameter. In both cases the thread feed system has an integrated intelligence which permits an automatic adaptation of the system to varying operative states.

BRIEF DESCRIPTION OF THE DRAWINGS

Embodiments of the invention shall now be explained with reference to the drawings in which.

DETAILED DESCRIPTION

Figure 1:
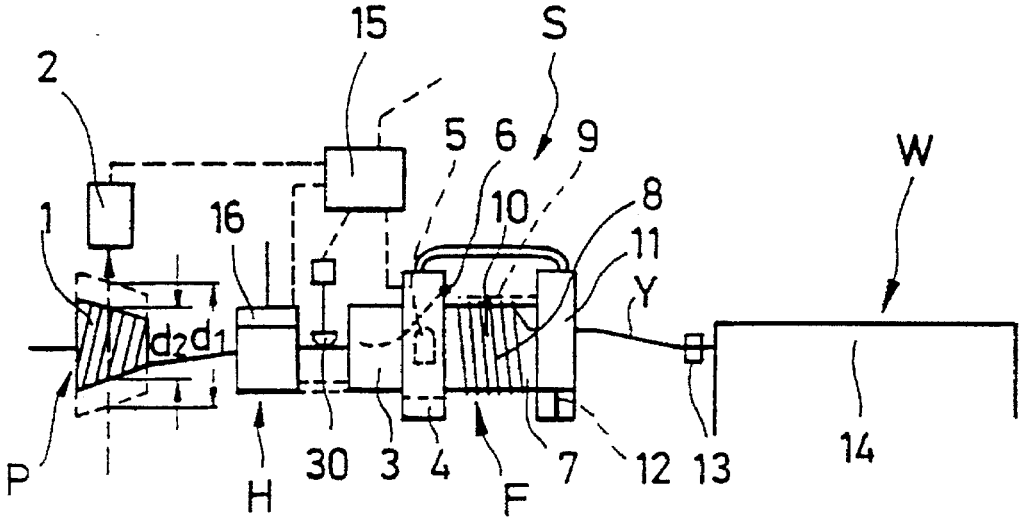
FIG. 1 is a side elevational view diagrammatically showing a thread feed system having a measuring feeder and a supply bobbin.

A thread feed system S according to FIG. 1 comprises a supply bobbin P, an auxiliary conveyor device H arranged downstream thereof and a measuring feeder F which provides a textile machine W, such as a jet weaving machine, with thread sections of a set thread length. Thread Y which is withdrawn from thread windings 1 on supply bobbin P passes through the auxiliary conveyor device H which is optionally secured (as outlined in broken line) to the inlet end of the measuring feeder F, is moved in the measuring feeder F on a storage drum 7 in a plurality of turns into a thread stock 8 and is withdrawn clockwise and overend the storage drum 7.

The supply bobbin P can have assigned thereto a sensing device 2 for sensing the diameter of the thread windings 1 to produce a signal as soon as diameter d1 of thread windings 1 falls below a diameter d2. Alternatively, the sensing device 2 could also monitor the amount of unwound thread and produce a signal from a predetermined residual amount of thread onwards.

The measuring feeder F has a housing 3 in which a control means 4 is accommodated for a drive motor 5 of a winding element 6 and in which the storage drum 7 is non-rotatably supported. The storage drum 7 has assigned thereto a stop device 11 which has arranged therein at least one retractable and extendable stop element 12. With only one stop element 12, it is possible to adjust the diameter of the storage drum 7 for setting the thread length. In cases where a plurality of circumferentially distributed stop elements 12 are provided in the stop device 11, the storage drum 7 has an invariable diameter.

A respective section is introduced into a compartment 14 with a picking device 13 of the textile machine W. A central control device 15 is connected to the measuring feeder F, optionally to the auxiliary conveyor device H or drives 16 thereof, or optionally to the sensing device 2. A thread tension or thread speed meter 30 may be provided on the thread path and connected to control device 15. Further thread feed systems of a similar type can be linked with control device 15. On the storage drum 7, a circumferentially defined longitudinal section 9 (outlined in broken line) can be moved by means of a power accumulator 10, which is symbolized by an arrow, from a passive position withdrawn into or below the enveloping surface of the storage drum 7, into the compensating position shown in broken line for increasing the turns on storage drum 7.

A thread stock 8 is formed on storage drum 7 during operation. The thread length per pick is set either with the aid of the storage drum diameter or by selecting the stop elements 12 to be respectively actuated, i.e., in consideration of the thread tension created during winding in thread stock 8. Thread Y is elastic in longitudinal direction, so that the thread tension in the turns has the effect that during relaxation the picked thread section will shorten to the thread length needed in the compartment. As soon as weaving machine W is ready to withdraw a section, the stop element is disengaged. Shortly before the time when the set thread length is removed, the stop element 12 or a predetermined stop element 12 will be engaged, so that thread Y will be stopped when the thread length has been reached. Drive 5 supplements thread stock 8 on the storage drum 7 subsequently and/or in the meantime. When the diameter of thread windings 1 on supply bobbin P falls below d2, the withdrawal resistance has risen considerably. This constitutes an operating condition which is critical with respect to the observance of the set thread length, since at an increased thread tension in the turns on the storage drum 7 the withdrawn thread section will shorten to a higher degree after picking and fall below the set thread length. When such a critical operating condition arises, the control device 15 receives, for instance from sensing device 2, a signal on the basis of which drive 16 of the auxiliary conveyor device is activated or the auxiliary conveyor device H is moved into frictional engagement with thread Y. As a result, the thread tension in the thread path to the measuring feeder 7 and in the turns on storage drum 7 is reduced to a lower level to maintain the thread length introduced into compartment 14. Alternatively or additively, the power accumulator 10 is triggered and the longitudinal section 9 is brought into its compensating position, whereby the thread turns 8 are increased, in particular the thread turns 8 which have been wound up after the adjustment of the longitudinal section 8. A thread section is then released that is per se longer and has again the set thread length in its relaxed form.

The auxiliary conveyor device H operates or advances the yarn with a slip, optionally such that it intensifies its influence as an auxiliary conveyor means approximately linearly or analogously with the decrease in diameter of thread windings 1. More particularly, the auxiliary conveyor device pushes or advances the yarn, although some slippage of the yarn occurs relative to the auxiliary conveyor device. Furthermore, it is possible to move the longitudinal section 9 with a delay with respect to the activation of the auxiliary conveyor device H into the compensating position. The auxiliary conveyor device H and/or the longitudinal section 9 can also be operated in response to the signal from the measuring device 30 or a thread breakage detector in another measuring feeder F.

After the end of the critical operating condition, for instance after a change to a new supply bobbin P or after the elimination of a thread breakage, the auxiliary conveyor device H is stopped or brought out of engagement and/or the longitudinal section 9 is moved back into the passive position.

Figure 2:
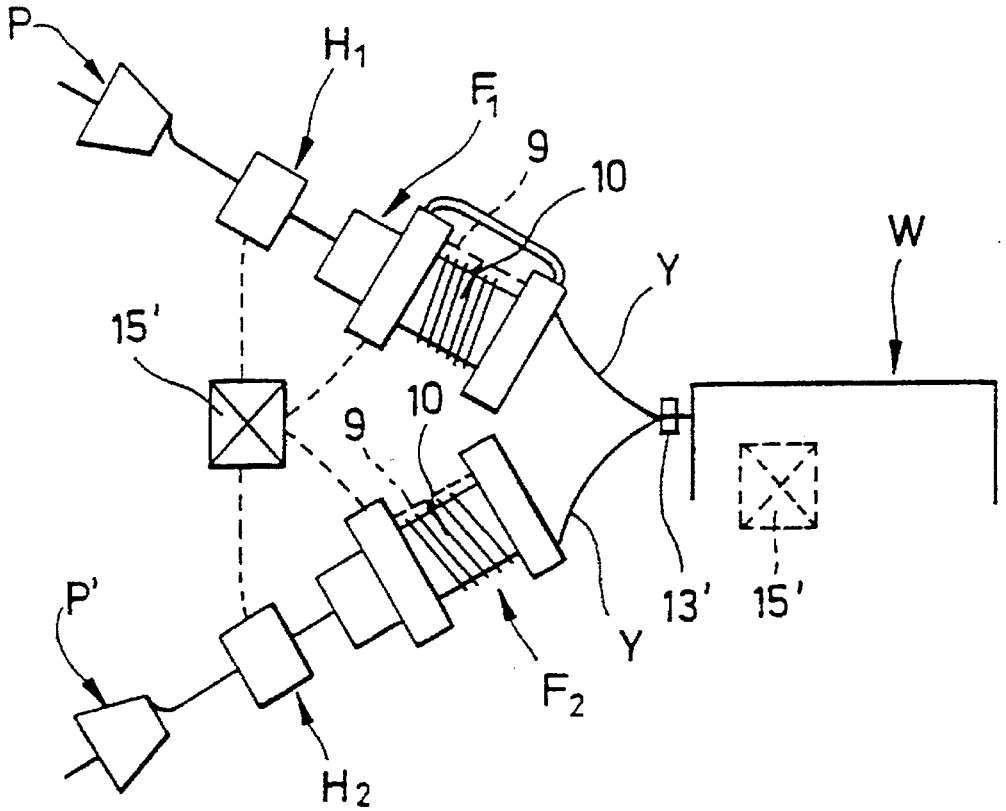
FIG. 2 is a side elevational view showing a thread feed system comprising at least two measuring feeders.

In FIG. 2, the thread feed system comprises two (or a plurality of) measuring feeders F1, F2 with upstream auxiliary conveyor devices H1, H2 and supply bobbins P and a central control device 15'. The two threads are identical. The measuring feeders F1, F2 operate in accordance with the weft mixing method, i.e., alternately, wherein the change can be initiated by the picking device 13' or the central control device 15'. A change is possible after every pick or only after a plurality of picks. The purpose of the weft mixing method is to improve the quality of the woven fabric and to reduce the speed level in every measuring feeder.

In case of a fault message from one of the measuring feeders F1, F2 (for instance in case of thread breakage) the control device 15' puts the faulty measuring feeder temporarily out of operation and prompts at least one of the other measuring feeders to take over the function of the faulty measuring feeder. This yields a higher picking frequency at a higher speed level for this measuring feeder and an operating condition which is critical with respect to the observance of the set thread length. That is why the control device 15' actuates either the respective auxiliary conveyor device H1, H2 and/or the longitudinal section 9 for adjustment into the compensating position. In each measuring feeder F1 and F2, respectively, it is either only the auxiliary conveyor device H1, H2 or only the adjustable longitudinal section 9 that may be provided for. However, it is also possible, as shown, to provide and use both components in combination. Furthermore, it is possible, as in FIG. 1, to sense either the diameter of the thread windings on the supply bobbin P and/or the thread tension or thread speed and to use the signals obtained for control purposes.

Figures 3A, 3B:
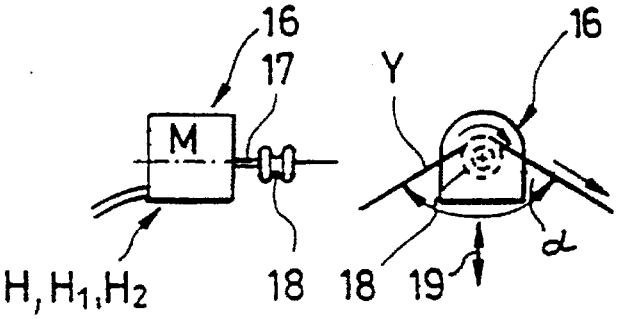
FIG. 3*a* is a side elevational view of an auxiliary conveyor device.
FIG. 3*b* is a front elevational view of the auxiliary conveyor device of FIG. 3*a;*

In FIGS. 3*a* and 3*b*, the auxiliary conveyor device H, H1, H2 comprises an electric motor M as a drive 16 for a friction roll 18 arranged on a motor shaft 17, which is wrapped by thread Y with an angled. Friction roll 18 operates with a slip whereby the yarn slips relative to the friction roll. The friction roll 18 must therefore be provided in the contact area with at least one circumferential speed that is higher than the instantaneous withdrawal speed of yarn Y from the supply bobbin, for instance by 10–15%. This withdrawal speed from the supply bobbin is also referred to as the winding-on speed of the yarn Y onto the storage drum 7. The intensity of the auxiliary delivery can be modified by changing the wrap angled, for instance by adjusting the auxiliary conveyor device H, H1, H2 in the direction of a double-headed arrow 19. This adjustment can also be used for activating the auxiliary conveyor device at all.

Figure 4:
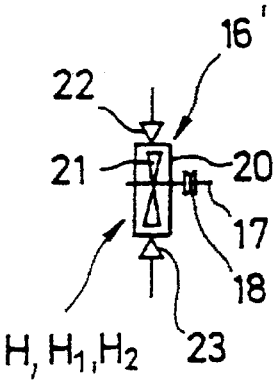
FIG. 4 is a side elevational view of an alternative embodiment of the auxiliary conveyor device.

As shown in FIG. 4, drive 16' of the auxiliary conveyor device H, H1, H2 is a compressed-air turbine 21 which is mounted in a housing 20 and acted upon via an inlet 22 and which prompts the used compressed-air to flow out via an outlet 23. Friction roll 18 is mounted on turbine shaft 17 for rotation therewith.

Figure 5A:
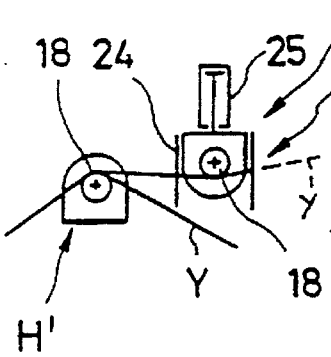
FIG. 5*a* is a front elevational view of a further embodiment of the auxiliary conveyor device in a first working position.
Figure 5B:
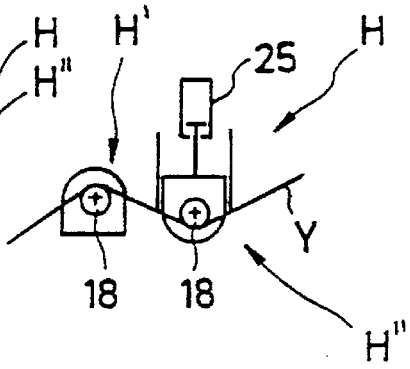
FIG. 5*b* is a front elevational view of the auxiliary conveyor device of FIG. 5*a* illustrated in a second working position.

In FIGS. 5*a* and 5*b*, the auxiliary conveyor device H is composed of two friction drives H' and H", with friction drive H' auxiliarily conveying, for instance, permanently, thread Y by means of friction roll 18 while the second friction drive H2 is activated by means of an adjusting unit 25 in a guide 24, if necessary. According to FIG. 5*b*, the friction roll 18 of the second friction drive H" becomes only operative under an operating condition which is for instance critical for the observance of the thread length, so that the thread Y is deflected on both friction rolls. The deflection angles on both friction rolls 18 can be changed by correspondingly adjusting the second friction drive H2, so that the auxiliary conveying effect on the whole can be both friction rolls 18 permanently rest on thread Y and where only one is driven to compensate for the braking of the other one may be expedient. It is only in of case of need that both rolls are driven.

Figure 6:
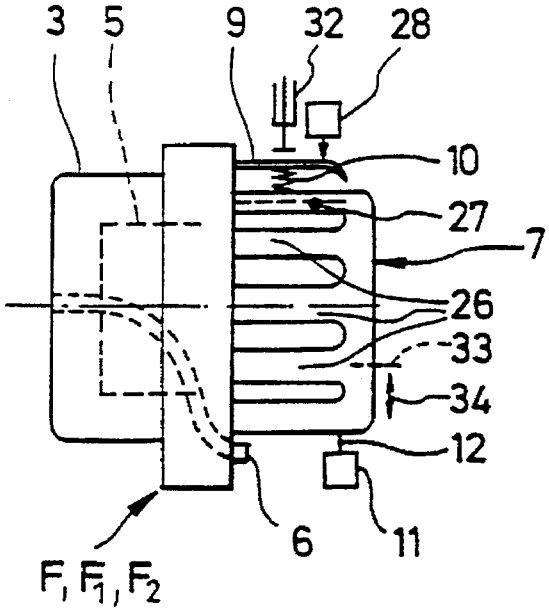
FIG. 6 is an enlarged side elevational view of a measuring feeder.

In the measuring feeder F, F1, F2 according to FIG. 6, the storage drum 7 is formed as a rod cage with axial rods 26. In case the stop device 11 includes a plurality of stop elements 12, the diameter of the storage drum 7 is invariable. If, as outlined, there is only provided one element 12, it is possible to adjust the outer diameter of the storage drum 7, for which purpose rods 26 mounted on spokes 33 which are adjustable individually or jointly radially in the direction of a double-headed arrow 34. Irrespective of whether the storage drum diameter is fixed or variable, at least one rod 26 or a longitudinal section 9 arranged at a rod 26 is adjustable between the passive position shown in broken line, in which it is approximately in alignment with the enveloping surface of storage drum 7, and the compensating position shown in full lines. The longitudinal section 9 can be adjusted outwardly in parallel with itself or with the axis of the storage drum or can be pivoted outwardly about a tangential pivot axis located near the front end of the storage drum. The power accumulator 10 is seated inside the storage drum 7. The longitudinal section 9 or the rod or finger, respectively, is optionally retained in the passive position with the aid of a lock 27. A trigger 28 outside storage drum 7 is operated for releasing lock 27, thereby enabling power accumulator 10 to adjust the longitudinal section. After the end of the critical operating condition the longitudinal section 9 is moved back into the passive position by means Of a resetting drive 28 and is locked. The adjustable rod 26 or the longitudinal section 9 should extend on the one hand under the outlet of winding device 6 and on the other hand at least over the length of thread stock 8 to act on all turns.

Figure 7:
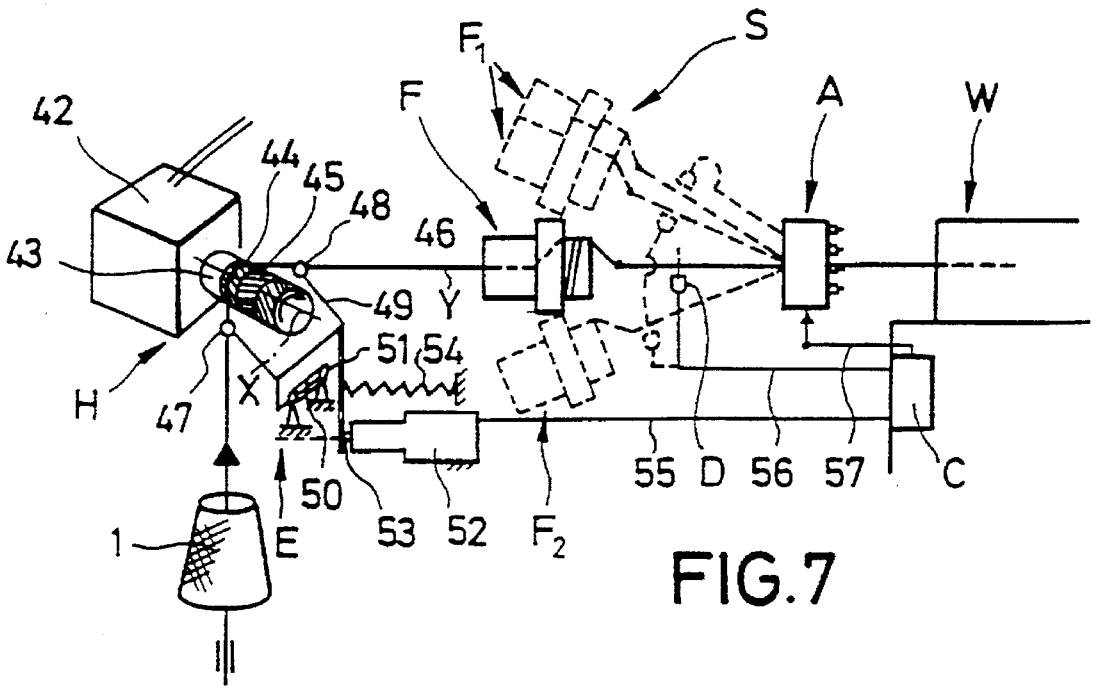
FIG. 7 is a side elevational view diagrammatically illustrating a further embodiment of the measuring feeder.

The thread feed system S according to FIG. 7 is arranged on a weaving machine, such as an air-jet weaving machine W, which includes a thread selection means A which is connected to a control device C via a line 57. A plurality of measuring feeders F, F1, F2, for instance four, are arranged upstream of the selection means A, with an auxiliary conveyor device H being respectively provided upstream thereof. Every thread Y runs with a deflection via a rotational friction surface 43 of the auxiliary conveyor device H into the measuring feeder F, F1, F2, and from there to selection means A.

The auxiliary conveyor device H has a drive 42 for the rotational friction surface 43, the drive being an electromotive, pneumatic or mechanical drive. However, it is also possible that drive 42 is coupled directly or via a gear to the drive of the measuring feeder. The rotational friction surface 43 has a plurality of adjacent circumferential portions, for instance three circumferential portions 44, 45, 46 with different friction coefficients. The rotational axis of the rotational friction surface 43 is designated by X. Thread guiding elements 47, 48 are mounted on a support 49 which can be moved, for instance, pivoted, in a bearing 50 between several positions. An arm 51 which is connected to support 49 projects into the operating range of a plunger 53 of a drive 52 of an adjusting mechanism E. A spring holds arm 51 either on stops (not shown) or on plunger 53. Drive 52 is connected via a transmission connection 55 to the control device C and can be controlled by signals. A thread breakage or thread running detector D can be arranged in the thread path of each thread Y, the detector being linked via a line 56 to control device C.

During normal operation the control device C influences the selection means A such that threads Y can be removed alternately. All of the auxiliary conveyor devices H can be driven. Threads Y are, for instance, deflected on the circumferential portions with the smallest friction coefficients (these may be smooth or polished). In case of thread breakage or a critical operating condition with an increased winding-on tension level, this will be reported to the control device C, in case of thread breakage, for instance, via detector D. The control device controls the selection means A such that the broken thread, or the presently faulty measuring feeder, is ignored and excluded from the supply of the remaining threads to the textile machine which are then supplied at an increased rate to compensate for the unused measuring feeder. The winding-on speed level will therefore rise in the properly functioning measuring feeders. It is possible to allocate the intermediate storage function for the defective measuring feeler to one measuring feeder only. The winding-on speed level will then increase in this measuring feeder F only. At the same time, the control device C will supply a signal to drive 52 to shift the thread to a circumferential portion 44, 45, 46 having a higher friction coefficient and to increase the delivery rate. When several measuring feeders share the intermediate storage function of the defective measuring feeder, drives 52 of all of the auxiliary conveyor devices B are activated.

It is expedient when the rotational frictional surface 43 comprises a plurality of circumferential portions with different friction coefficients to be able to increase or vary the delivery rate several times. The rotational speed of the rotational friction surface 43 is so high from the start that a speed surplus exists at any rate. However, it is also possible to increase the rotational speed in steps or in a continuously variable manner in accordance with the increase in the winding-on speed level.

After the elimination of the thread breakage or thread breakages, the control device C can again control the selection means A in the original manner, so that all of the measuring feeders F can be used. At the same time, signals are transmitted to drives 52 for shifting threads Y to circumferential portions 44, 45, or 46 which have low friction coefficients for reducing the delivery rate.

Figure 10:
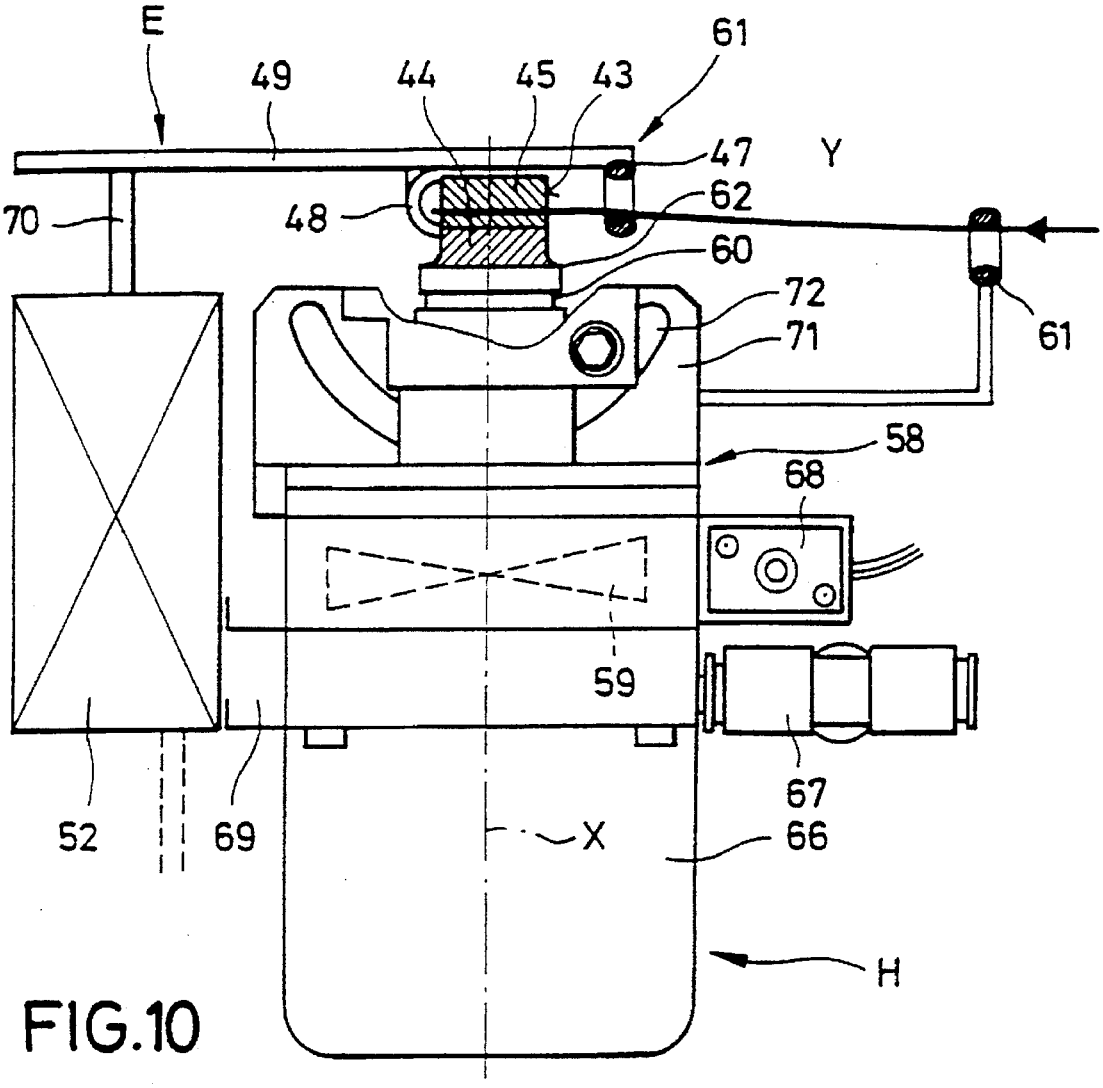
FIG. 10 is a side elevational view in partial section of the auxiliary conveyor device which is diagrammatically illustrated herein.

In FIG. 7, and also in FIG. 10, thread Y is adjusted relative to the rotational friction surface 43 which is immovable in the direction of the rotational axis X.

Figure 8:
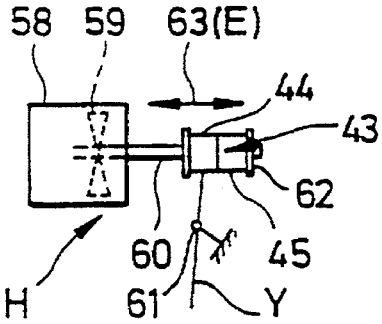
FIG. 8 is a side elevational view illustrating a further embodiment of the auxiliary conveyor device.

According to FIG. 8 the rotational frictional surface 43 is adjusted in the direction of the rotational axis X relative to thread Y extending in an unchanged position or with an unchanged geometry.

A housing 58 contains a compressed-air turbine 59 as a drive whose withdrawal shaft 60 drives a friction roll 62. The thread guiding elements 61 are stationary. The adjusting mechanism E acts on friction roll 62 in the direction of a double-headed arrow 63 so as to adjust the roll in the direction of rotational axis X.

Figure 9:
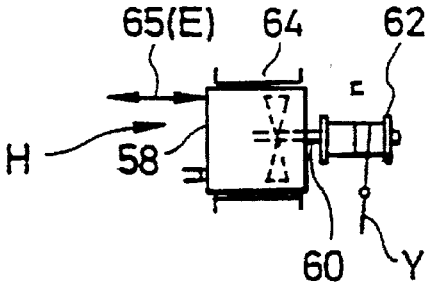
FIG. 9 is a side elevational view of the auxiliary conveyor device of FIG. 8.

In FIG. 9, thread Y is held with an unchanged geometry when the housing 58 of the auxiliary conveyor device H with friction roll 62 is adjusted in the direction of rotational axis X by the adjusting mechanism E (in the direction of a double-headed arrow 65). To this end, housing 58 is movably held in guides 64. Outlined stops secure the end positions of the housing 58. Friction roll 62 is secured to the output shaft 60 in the direction of the rotational axis X in an immovable manner and for rotation therewith. The rotational friction surface 43 has provided therein at least two adjacent circumferential portions 44, 45 with different coefficients of friction.

The thread guiding elements 47, 48 are, for instance, thread eyes or forks on a support 49 mounted on a plunger 70 of drive 52 (switching magnet or pneumatic or electromotive drive member). In this configuration according to FIG. 10, drive 52 is fixed with a mounting 69 onto housing 58. A stationary thread eye 61 and a compressed-air connection 67 (for supply of turbine 59), as well as an electromagnetically operable valve 68 for switching on and off and for regulating the amount of compressed air so as to set the turbine speed are positioned between thread stock 1 (not shown) and the rotational frictional surface 43. The auxiliary conveyor device H is secured with a holding flange 71 to an abutment, for instance on the measuring feeder or the bobbin frame of bobbins P. An arc-shaped slot 72 makes it possible to pivot housing 58 for setting an optimum thread geometry. The thread guiding elements 47, 48 are offset by about 90° relative to each other about the rotational axis X. It is also possible to vary the offset and to influence the delivery rate through the wrap angle.

The rotational frictional surface could be conical or comprise conical circumferential portions 44, 45, 46. Alternatively, the circumferential portions 44, 45, 46 could comprise different diameters and could be separated by, for instance, rounded transitions which can easily be swept over by thread Y. The circumferential portions 44, 45, 46 consist, for instance, of a ceramic material, of metal or of heat-treated or treated metal or of a plastic material with a high resistance to abrasion, a uniform surface roughness and a constant friction coefficient.

Figure 11:
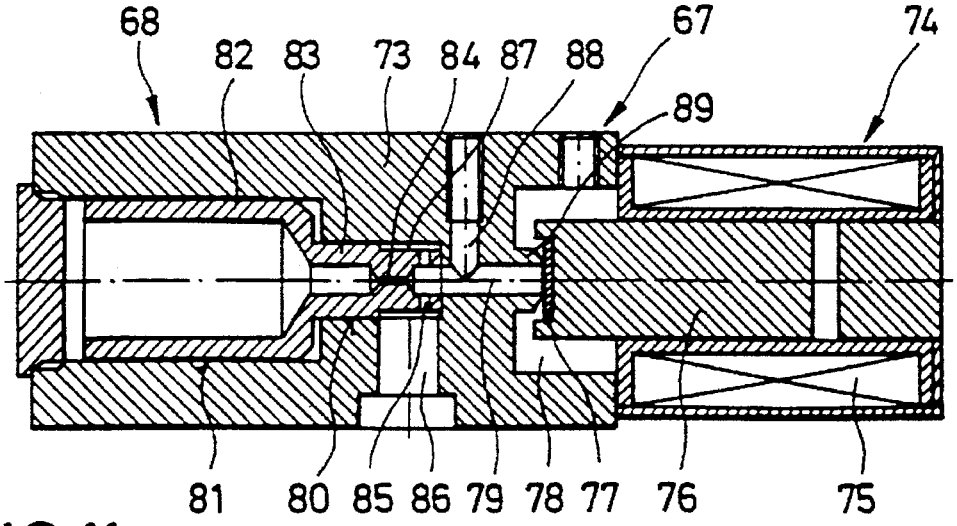
FIG. 11 is a side elevational view in cross-section illustrating a further embodiment of the auxiliary conveyor device of FIG. 10.

In a longitudinal section, FIG. 11 illustrates a possible embodiment of valve 68 of FIG. 10. Valve 68 is here a valve which can be electromagnetically switched over between a shut-off position and a passage position and includes a housing 73 which has mounted thereon a switching magnet 74 with a coil 75 and an axially movable armature 76. Armature 76 is equipped at its bottom end with a small sealing plate 77 and projects into a chamber 78 of housing 73 which the compressed-air connection 67 leads to. Armature 76 is expediently pressure-compensated, so that it can easily be adjusted despite the pressure prevailing in chamber 78. Armature 76 is expediently held by a spring (not shown) in the illustrated shut-off position in which it presses the small sealing plate 77 onto a valve seat 89. Upon excitation of coil 75 it is drawn towards a rear stop, thereby releasing the connection from chamber 78 to an axial channel 79 of a flow path to a turbine connection 86. A branched hole 88 is branched off from axial channel 79 and is optionally connected to an adjusting drive, for instance, for a pivotal adjustment of the auxiliary conveyor device H. When not needed, the branched channel 88 is closed by a stopper (as shown).

The axial channel 79 terminates in a hole 80 of a small diameter Which extends at the side facing away from the axial channel 79 through a coaxial hole of a large diameter. A differential piston 82 is slidably guided in holes 80 and 81 between a control position shown in full lines and a release position spaced apart from axial channel 79. The differential piston 82 has an end section 83 of a small diameter which engages into hole 80 and contains a restricting path 84. Radial control passages 85 which are in flow communication with the axial channel 79 lead to an axially defined turned groove 87 of the end section 83.

In the illustrated shut-off position of valve 68 and with the differential piston 82 being in the control position, the axial channel 79 is connected to the turbine connection 86 via control passages 85 which set a specific amount of air with their cross-sections. The front side of the end section 83 separates the turbine connection 86 from the axial channel 79.

When valve 68 is switched over into the passage position, the armature 76 is drawn into is end position at the right side upon excitation of coil 75. The small valve plate 77 lifts from valve seat 89. Chamber 78 is connected to the axial passage 79. Compressed air acts on the differential piston 82 on the front end surface of end section 83 and displaces it into the release position to the left. The annular end surface of the large-diameter member of the differential piston 82 is expediently pressure-relieved. The axial channel 79 is directly connected to the turbine connection 86, thereby permitting a compressed-air throughput to the turbine which is substantially uncontrolled. The restricting path is dimensioned such that the pressure prevailing in the axial channel 79 propagates towards the larger actuation side of the differential piston 82 as soon as the compressed-air turbine has been accelerated to a sufficient speed. Owing to the difference in area between holes 81 and 80, the differential piston is again pushed back into the illustrated control position in which it separates the axial channel 79 from the turbine connection 86. The compressed air is forced through the control passages 85 whose cross-section is designed for a predetermined amount of air corresponding to a specific speed of the turbine.

Valve 68 could also be operated mechanically or pneumatically upon activation of the compressed-air supply.

In view of the foregoing, in the embodiment wherein the auxiliary conveyor device has at least one friction drive which includes a drivable friction roll Upon which the thread rests, the thread is conveyed by an auxiliary means on the friction roll in the critical operating state and is so to speak pushed after to avoid an undesired increase in tension in the thread stock.

An expedient embodiment follows wherein the friction roll is disposed on a shaft which shaft is connected to a compressed-air turbine or an electric motor. A compressed-air turbine can be produced in an inexpensive manner, it can be of a small structure and controlled easily. The drive medium of compressed air is most of the time available at the textile machine at any rate.

The embodiment may also include two or more individually drivable friction rolls and/or an adjusting device provided for changing the wrap angle of the friction rolls. Additionally, this arrangement permits a modification of the auxiliary delivery of the thread, i.e., the auxiliary delivery is adapted to the respective operating condition and to the tension conditions in the thread, respectively.

Whenever the demands made on the auxiliary delivery of the thread change during operation, for instance upon occurrence of a critical operating condition, the delivery rate will be adapted accordingly by conveying the thread on a circumferential portion of the rotational friction surfaces in an auxiliary manner, with the circumferential portion having a friction coefficient differing from that of the previously used circumferential portion. The delivery rate can thus be increased or reduced and adapted to the changed needs in this manner. The rotational friction surface is always driven with a speed surplus with respect to the winding-on speed of the thread onto the storage drum so as to convey the thread with a slip.

In the embodiment wherein the drive of the adjusting mechanism is connected to a control device that varies the winding-on speed of the measuring feeder, the winding-on speed level is varied in such a manner that the thread is movable from one circumferential portion to another one on the auxiliary conveyor device during a predetermined increase in withdrawal speed level so as to also increase the delivery rate of the thread. The circumferential portion of the rotational friction surface with the different friction coefficient is used for auxiliary conveying purposes whenever an increase in the winding-on speed level does effect an undesired increase in the winding-on tension level in the thread and in the thread stock.

In the embodiment wherein the adjusting mechanism comprises at least one thread guiding element that is adapted to be brought into engagement with the thread in the direction of the rotational axis, the thread guiding element can be adjusted in this direction of the rotational axis between a plurality of positions corresponding in number and arrangement to the circumferential portions of the rotational friction surface either in one step or in a continuously variable manner. The thread thereby is adjusted in the direction of the rotational axis relative to the rotational friction surface and shifted from one circumferential portion to another one.

The embodiment wherein the two thread guiding elements are offset by about 90 degrees and assigned to the rotational friction surface is of a simple construction and functions in a reliable manner. The two thread guiding elements are arranged on a support that is mounted on a plunger which plunger is adjustable and parallel with the rotational axis by having a magnetic, pneumatic or electromotive drive. The drive shifts the support and the thread guiding elements so that the thread is displaced from one circumferential portion to another one. It remains substantially deflected at about 90 degrees. However, it is also possible to change the offset of the guiding elements to vary the thread delivery rate via the wrap angle.

The embodiment wherein the drive is mounted on a housing which housing accommodates either the compressed-air turbine or, optionally, a pressure accumulator, the friction roll is mounted on an output shaft projecting from the housing. In particular, this embodiment uses the compressed-air turbine to reach the necessary speed level of the rotational friction surface. The turbine can easily be controlled. However, an electric motor as a drive source can also be expedient.

The embodiment wherein the compressed-air connection and the turbine connection have an electromagnetic valve therebetween which is switchable between a shut-off position and a pass-through position, is especially expedient because the valve is not only responsible for the activation or deactivation of the compressed-air turbine, but includes, with the differential piston, an element which performs a control function in response to pressure and independently releases the flow path in a substantially unrestricted manner for the rapid start of the compressed-air turbine. The valve assumes its control position independently as soon as the compressed-air turbine has been accelerated to a sufficient speed and then adjusts the amount of air for the turbine to keep the necessary operating speed. Hence, the differential piston constitutes a starting aid for the compressed-air turbine and then controls the amount of air to avoid any waste of compressed air. When the differential piston is used, a pressure accumulator can optionally be dispensed with.

The alternative embodiment wherein the rotational friction surface is arranged on a drivable friction roll has the advantage that the thread in the thread path need not be adjusted because either the friction roll or the auxiliary conveyor device is adjusted axially to move or shift a different circumferential portion to a position below the thread. As a rule, the auxiliary conveyor device provides for an increased weft frequency and thus for an improved exploitation of the capacity of the weaving machine without any increase in the thread breakage percentage.

In the embodiment wherein the circumferential portions have a cylindrical shape and are provided with different diameters and have rounded or bevelled transitions therebetween, the different diameters are responsible for higher or lower delivery rates.

In the embodiment wherein the rotational friction surface or the circumferential portions have a conical shape, the delivery rate is continuously variable. In both cases, the drive of the auxiliary conveyor device can optionally run at about the same speed even in the case of a changing withdrawal speed level.

In the embodiment wherein the longitudinal section of the storage drum is an axial rod formed as a rod cage, the rod or a rod inside the rod of the rod drum is abruptly moved into the compensating position whenever the critical operating condition arises. The circumferential length of the storage drum thereby is increased. An addition to the set thread length compensates for the increasing thread tension. The relaxed thread section which is extended by the addition will then predominantly comply with the set thread length. The resetting drive will later reset the rod into the optionally locked passive position.

In the embodiment wherein further measuring feeders are provided which are connected to a control device, the auxiliary conveyor device or the adjusting mechanism and/or the trigger of the power accumulator is activated by the control device when the same initiates the critical operating condition. In the weft mixing method this is the case whenever one of a plurality of measuring feeders temporarily takes over the function of at least one other measuring feeder.

In the embodiment wherein the recognition means includes a thread-tension, thread-speed, or drive-speed measuring device or a thread breakage detector or thread monitor, an actuation is performed whenever the sensing device detects that the winding-on tension will excessively rise on account of the diameter of the supply bobbin and/or the remaining thread amount on the supply bobbin.

In the embodiment wherein a recognition means is provided for recognizing operating conditions or changes in operating conditions, the recognition means activates the auxiliary conveyor device and/or the power accumulator upon occurrence of a critical operating condition.

In the embodiment wherein the recognition means includes a thread-tension, thread-speed, or drive-speed measuring device or a thread breakage detector or thread monitor, the recognition means has provided therein measuring devices or sensors which directly sense the thread and produce signals representative of the operating conditions or a change in the operating conditions. The thread tension can, for instance, be sensed with a tensiometer which produces a signal at a specific tension limit. The speed measuring device for measuring the winding-on speed of the thread can be set to a specific speed limit. The thread breakage detector (thread monitor) signals during weft mixing weaving that the measuring feeder in question has to take over the function of another one and that the thread tension will rise.

It is important to note that the method and the thread feed system will respond to a change towards a critical operating condition sufficiently rapidly. The termination or changing of the auxiliary conveyance and/or the reduction of the turns in the thread stock after the end of the critical operating condition can be performed at a relatively slow pace because excessively long free ends of the weft threads which occur during a short period can be tolerated.

Also, in the thread-processing thread feed system wherein a plurality of measuring feeders are provided, a respective auxiliary conveyor device provided upstream of each measuring feeder includes a drivable adjusting mechanism to vary the frequency or delivery rate of the thread being provided to the storage drum. The thread consumed at a higher frequency is conveyed in an auxiliary manner after thread breakage to a circumferential portion which has a higher coefficient of friction. The delivery rate is thereby increased and an undesired increase in the thread winding-on tension and the tension level in the turns on the storage drum is compensated. The pick length does not change significantly, so that the pick length can be set to be optimally short in advance. The result is a minimized loss of thread material without the risk of excessively short thread lengths.

We claim:

1. A method for controlling a thread feed system comprising at least one measuring feeder which includes a storage drum for storing turns of thread thereon, a supply bobbin associated therewith for supplying said thread to said storage drum, a winding element for winding said thread in said turns on said storage drum and a textile machine which withdraws said thread from said measuring feeder for introduction into a weaving compartment of said textile machine, said thread being withdrawn from said measuring feeder in thread sections of a thread length which is set on said measuring feeder, said method comprising the steps of supplying thread along a thread path from said supply bobbin to said storage drum, winding said thread on said storage drum, and withdrawing said thread from said storage drum to said textile machine, the method being adapted to be performed at least temporarily under operating conditions in which a thread tension in said turns of thread on said storage drum increases with an increasing winding speed and/or an increasing resistance to withdrawal from said supply bobbin, the improvement comprising counteracting an increase in the thread tension in said thread turns on said storage drum in response to said operating conditions by applying an additional frictional conveying action on said thread in said thread path between said supply bobbin and said storage drum so as to convey said thread at an increased delivery rate, and sensing said operating conditions which increase said thread tension, said additional frictional action being applied to said thread in response to said sensing of said operating conditions.

2. A thread feed system comprising at least one measuring feeder, a supply bobbin assigned thereto for supplying a thread to said measuring feeder and a textile machine which withdraws said thread from said measuring feeder in thread sections of a thread length which is set on said measuring feeder, said measuring feeder including a storage drum for storing turns of said thread in a thread stock on said storage drum and a winding element which is rotatable relative to said storage drum by drive means for rotating said winding element to form said turns of said thread stock at a winding-on speed, the improvement comprising a control device which is provided for sensing and/or monitoring and/or recognizing operating conditions which increase a thread tension in said thread turns on said storage drum, and an auxiliary conveyor device which has at least one friction drive with a drivable friction roll and is disposed in a thread path between said supply bobbin and said measuring feeder, said auxiliary conveyor device being connected to communication means for communicating said auxiliary conveyor device with said control device, said auxiliary conveyor device being adapted to be activated by said control device for providing an additional frictional delivery of said thread to said measuring feeder in response to said operating conditions to counteract an increase in said thread tension.

3. The thread feed system according to claim 2, wherein during operation of said thread feed system a longitudinal section which is defined in a circumferential direction of said storage drum can be adjusted from a passive position into a compensating position projecting outwardly of an adjacent circumferential surface of said storage drum, a triggerable power accumulator for abruptly displacing said longitudinal section into said compensating position being provided in said storage drum.

4. The thread feed system according to claim 3, wherein said control device includes a sensing device for sensing the diameter or amount of thread on said supply bobbin said sensing device being in communication with said auxiliary conveyor device and the adjusting mechanism thereof and/or said power accumulator and said trigger thereof through said communication means, said auxiliary conveyor device and said adjusting mechanism and/or said power accumulator being activated by said control device as said thread is supplied from said supply bobbin from a predetermined bobbin diameter or a predetermined amount of thread onwards.

5. The thread feed system according to claim 3, wherein said longitudinal section is an axial rod of said storage drum which is formed as a rod cage, said rod being connected to said storage drum so as to be adjustable in parallel with itself or be pivotable about an axis positioned near a front drum end at a withdrawal side thereof, said power accumulator being arranged inside said storage drum at said longitudinal section, a mechanical or contactless trigger for said power accumulator or for a lock being provided radially outside of said storage drum for triggering said power accumulator to said compensating position, a mechanical resetting drive for said longitudinal section being provided radially outside said storage drum for resetting said power accumulator to said passive position.

6. The thread feed system according to claim 3, wherein at least one further measuring feeder is provided on said textile machine, said measuring feeders being connected jointly to said control device for an alternate operation at low frequencies or for the individual operation of only one measuring feeder at a correspondingly higher frequency upon a failure or malfunction of said other measuring feeder in response of a thread breakage detector, said control device being in control communication with said auxiliary conveyor device and/or said trigger of said power accumulator by said communication means in such a manner that during individual operation of said one measuring feeder the auxiliary conveyor device thereof is activated and/or the power accumulator thereof is triggered.

7. The thread feed system according to claim 3, wherein said control device comprises an electronic recognition means for recognizing the operating conditions of said thread feed system, said recognition means being in communication via said control device with said auxiliary conveyor device and the adjusting mechanism thereof and/or said power accumulator and said trigger, respectively.

8. The thread feed system according to claim 7, wherein said recognition means includes a thread-tension, thread-speed or drive-speed measuring device or a thread breakage detector or thread monitor.

9. The thread feed system according to claim 2, wherein said friction roll is arranged on a shaft which is connected to a compressed-air turbine, flow path means being connected to said turbine between a turbine connection and a compressed-air connection for defining a flow path therebetween.

10. The thread feed system according to claim 9, wherein on a housing of said auxiliary conveyor device between said compressed-air connection and said turbine connection there is provided a valve which is operable between a shut-off position and a passage position for adjusting said flow path, said valve in the flow path between said turbine and compressed-air connections including a differential piston which can be acted upon at one end directly and at the other end via a restricting path, said differential piston being movably guided in response to pressure between a release position and a control position, said differential piston comprising control passages which in the control position adjust the amount of air flowing through said flow path for said turbine, and in the release position release the flow path in a substantially unrestricted manner.

11. The thread feed system according to claim 2, wherein two or more individually drivable friction rolls and an adjusting device are provided for changing a wrap angle of said thread on said friction rolls.

12. The thread feed system according to claim 2, wherein a rotational friction surface of said friction roll comprises a plurality of circumferentially closed circumferential portions with different friction coefficients which are disposed side by side, a drivable adjusting mechanism being provided which includes drive means for shifting said thread from one said circumferential portion to another one of said circumferential portions during said winding of said thread by shifting said circumferential portions relative to said thread in the direction of a rotational axis of said rotational friction surface so as to vary the thread delivery rate of said thread.

13. The thread feed system according to claim 12, wherein said circumferential portions have a cylindrical shape and are provided with different diameters, optionally with rounded or bevelled transitions from one diameter to the next one.

14. The thread feed system according to claim 12, wherein a plurality of measuring feeders which temporarily store identical threads are adapted to be provided on said textile machine;

a respective said auxiliary conveyor device being provided upstream of each of said measuring feeders and including a said friction roll which has a said drivable adjusting mechanism for relative shifting of said thread from a said circumferential portion to another said circumferential portion by shifting said circumferential portions relative to said thread in the direction of said rotational axis so as to vary the delivery rate of said thread, said control device being connected to a thread selection means of said weaving machine for alternately using said threads which are temporarily stored on said measuring feeders, said control device activating said selection means upon a breakage of said thread on at least one of said measuring feeders to ignore said broken thread and to transfer a temporary thread storing function to one or all of said other measuring feeders, transfer connections being arranged between said control device and the drive means of said adjusting mechanisms for communicating drive signals of said control device to said drive means for increasing, upon said thread breakage, the delivery rate of said thread or said threads for said other thread measuring feeders to which said temporary thread storing function has been transferred.

15. The thread feed system according to claim 12, wherein said rotational friction surface is arranged on said friction roll which is driven by drive means for driving said friction roll, said auxiliary conveyor device including support means for adjustably supporting said friction roll so that said rotational friction surface is movable in the direction of said rotational axis, and said adjusting mechanism being adapted to shift said friction roll or said auxiliary conveyor device in said direction of said rotational axis to adjust said friction roll relative to said thread.

16. The thread feed system according to claim 12, wherein said drive means of said adjusting mechanism is connected to said control device, said control device including thread selection means of said textile machine which varies the winding-on speed level of said thread being withdrawn from said measuring feeder in such a manner that at a predetermined increase in the winding-on speed level, said thread is movable by said adjusting mechanism for moving said thread from one circumferential portion to another one in said auxiliary conveyor device to increase the delivery rate of said thread.

17. The thread feed system according to claim 16, wherein said adjusting mechanism comprises at least one thread guiding element connected to said drive means which is at least adapted to be brought into engagement with said thread in the direction of said rotational axis in at least one step or in a continuously variable manner, said thread guiding element being adjusted in the direction of said rotational axis by said drive means between a plurality of adjustment positions corresponding in number and arrangement to said circumferential portions of said rotational friction surface.

18. The thread feed system according to claim 17, wherein two said thread guiding elements which are offset by about 90° about said rotational axis and assigned to said rotational friction surface are arranged on a support which is mounted on a plunger, said plunger being connected to said drive means so as to be adjusted in parallel with said rotational axis between the adjustment positions.

* * * * *